US008477071B2

(12) United States Patent
Tsai et al.

(10) Patent No.: US 8,477,071 B2
(45) Date of Patent: Jul. 2, 2013

(54) MULTI-BAND ANTENNA

(75) Inventors: Yung-Chih Tsai, Taipei (TW); Jia-Hung Su, Taipei (TW); Kai Shih, Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 426 days.

(21) Appl. No.: 12/980,333

(22) Filed: Dec. 29, 2010

(65) Prior Publication Data

US 2012/0169563 A1 Jul. 5, 2012

(51) Int. Cl.
*H01Q 1/38* (2006.01)
*H01Q 13/10* (2006.01)
*H01Q 9/00* (2006.01)

(52) U.S. Cl.
USPC ..... 343/700 MS; 343/767; 343/749

(58) Field of Classification Search
USPC ..... 343/700 MS, 749, 767
See application file for complete search history.

*Primary Examiner* — Douglas W Owens
*Assistant Examiner* — Jae Kim

(57) ABSTRACT

A multi-band antenna mounted on a circuit board includes a ground plate perpendicularly connected to one side edge of the circuit board, a radiating plate perpendicularly connected to the other side edge of the circuit board, and a planar antenna element includes a high frequency radiating portion, a lower frequency radiating portion, a base plate, a capacitance portion and an inductance portion. The high frequency radiating portion and the lower frequency radiating portion are located at two ends of the circuit board, respectively, and both connected to the radiating plate. The base plate is connected to the radiating plate and located between the high and lower frequency radiating portions. The capacitance portion is parallel with the ground plate to form a capacitive coupling therebetween. The inductance portion is soldered to the ground plate. A simulation inductance is formed by the inductance portion.

9 Claims, 2 Drawing Sheets

MULTI-BAND ANTENNA

BACKGROUND OF THE INVENTION

1. Field of the Invention

The present invention relates to a multi-band antenna, and more particularly to a multi-band antenna having a structure with a lower cost.

2. The Related Art

With the fast development of mobile communication technology, more and more portable mobile communication equipments, such as mobile phones and notebooks, are installed antenna systems for working in wireless area network system anywhere and anytime by means of GPRS(General Packer Radio Service) and WLAN(Wireless Local Area Network). The portable mobile communication equipments can connect with internet by means of choosing different network cards matchable with the terminals of the portable mobile communication equipments. Currently, the wireless local network is based on bluetooth technology standard or IEEE 802.11 series standard. Working band of the antenna based on bluetooth technology standard is 2.4 GHz. Working band of the antenna based on IEEE 802.11 is respectively 2.4 GHz and 5 GHz. Working band of the antenna based on GPRS is 900 MHz, 1800 MHz and 1900 MHz.

However, the manufacturing cost of the common-used multi-band antennas of the portable mobile communication equipments described above is high, and high-frequency and lower-frequency electromagnetic wave bands received and emitted by the common-used multi-band antenna are also difficult to satisfy the need of wireless communication of the portable mobile communication equipments. Consequently, it's not beneficial for the multi-band antennas to be widely used in the portable mobile communication equipments.

SUMMARY OF THE INVENTION

An object of the present invention is to provide a multi-band antenna mounted on a circuit board. The multi-band antenna includes an elongated ground plate, a radiating plate and a planar antenna element. The elongated ground plate is perpendicularly connected to one side edge of the circuit board. The radiating plate is perpendicularly connected to the other side edge of the circuit board and facing to the ground plate. The planar antenna element disposed on the circuit board includes a high frequency radiating portion, a lower frequency radiating portion, a base plate, a capacitance portion and an inductance portion. The high frequency radiating portion is located at one end of the circuit board with a distal end connected to the radiating plate. The lower frequency radiating portion is located at the other end of the circuit board with one end thereof connected to the radiating plate. The base plate is located between the high and lower frequency radiating portions. The base plate is connected to the radiating plate and spaced from and adjacent to the ground plate. The high frequency radiating portion is extended from the base plate. The lower frequency radiating portion is spaced apart from the base plate. The base plate has a feeding point arranged at a portion thereof. The capacitance portion is extended from a side of the base plate opposite to the high frequency radiating portion and parallel with and adjacent to the ground plate to form a capacitive coupling between the capacitance portion and the ground plate. The inductance portion includes an elongated first strip and an L-shaped second strip connected with a distal end of the first strip. The first strip is extended opposite to the capacitance portion from a portion of an opposite side of the base plate adjacent to the ground plate. The second strip has a short arm connected with a distal end of the first strip and a long arm parallel with and facing to the first strip. The long arm is soldered to the ground plate. A slot is formed between the first strip and the second strip. A simulation inductance is formed by the inductance portion.

As described above, the antenna element, ground plate and radiating plate are mounted on the circuit board for saving occupied space so as to lower the manufacturing cost of the multi-band antenna. The multi-band antenna receives and transmits communication bands corresponding to GSM750 MHZ, GSM850 MHZ, GSM900 MHZ, DCS1800 MHZ, PCS1900 MHZ, WCDMA2100 MHZ and E-UTRA2.4 GHZ by means of the proper arrangement of the high frequency radiating portion, the lower frequency radiating portion, the capacitance portion, the ground plate, the radiating plate and the inductance portion to satisfy the need of multiple and wide bands of the electromagnetic wave requested by the portable mobile communication equipments.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
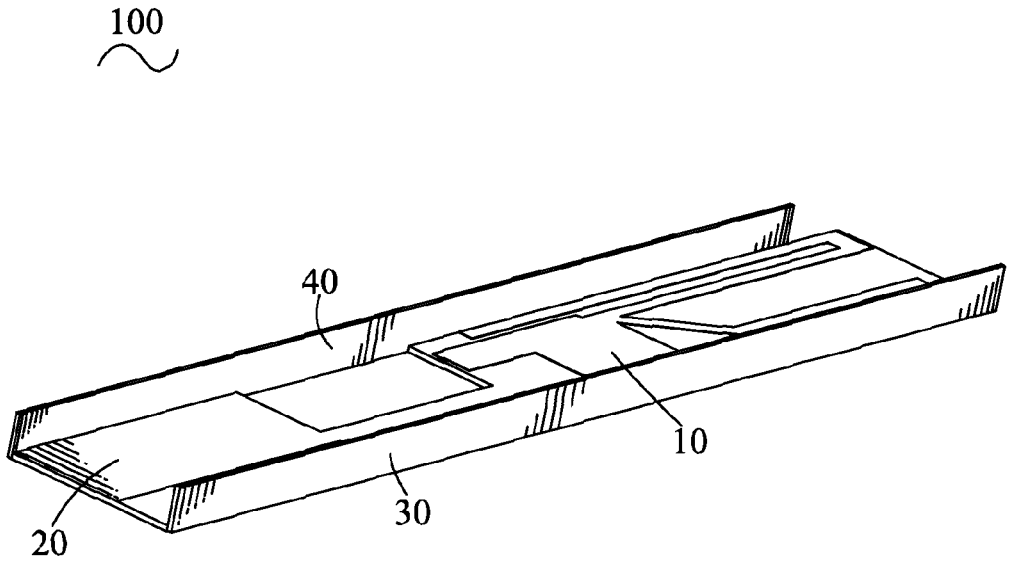
FIG. 1 is a perspective view illustrating the structure of a multi-band antenna of an embodiment in accordance with the present invention.

Referring to FIG. 1, an embodiment of a multi-band antenna 100 according to the present invention is shown. The multi-band antenna 100 mounted on a circuit board 20 may be formed by pattern etching a copper-plated sheet of synthetic material. The multi-band antenna 100 includes a planar antenna element 10, a radiating plate 30 and a ground plate 40. The antenna element 10 can connect with a radiating circuit of a portable mobile communication equipment by a feed cable.

Figure 2:
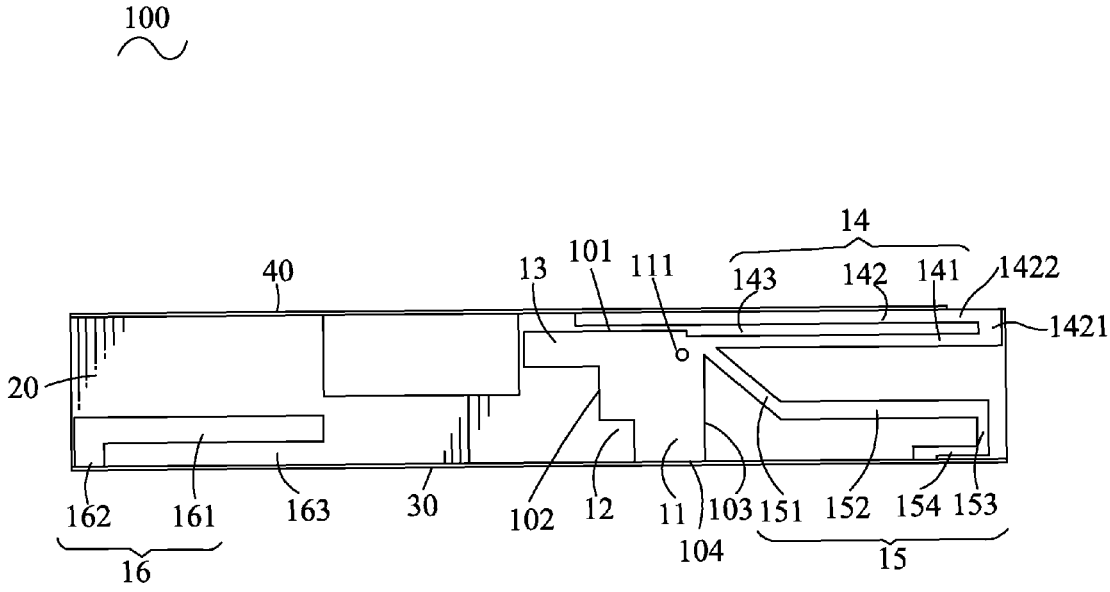
FIG. 2 is a vertical view of the multi-band antenna of the embodiment in accordance with the present invention.

Referring to FIG. 2, the ground plate 40 is of an elongated plate shape and perpendicularly connected to one side edge of the circuit board 20. The radiating plate 30 is used for receiving and transmitting lower-frequency electromagnetic signals. The radiating plate 30 is of an elongated plate shape and perpendicularly connected to the other side edge of the circuit board 20. The radiating plate 30 is parallel to and faces to the ground plate 40.

Referring to FIG. 2, the planar antenna element 10 mounted on the circuit board 20 includes a base plate 11, a capacitance portion 13, an inductance portion 14, a high frequency radiating portion 15 and a lower frequency radiating portion 16 which are coplanar with one another. The base plate 11 is located between the high and lower frequency radiating portions 15, 16. The base plate 11 is of a substantial rectangular shape, and has a first transverse edge 101, a second transverse edge 104 parallel to the first transverse edge 101 and opposite to the first transverse edge 101, a first longitudinal edge 102 and a second longitudinal edge 103 both connecting with the first and second transverse edges 101, 104 and opposite to each other. A gap 12 is formed at a corner of the base plate 11 adjacent to the radiating plate 30 and facing to the lower frequency radiating portion 16. The second transverse edge 104 is connected to the radiating plate 30 and the first transverse edge 101 is spaced from and adjacent to the ground plate 40. An upper portion of the first longitudinal edge 102 of the base plate 11 is extended transversely to form the capacitance portion 13 parallel with and adjacent to the ground plate 40 to form a capacitive coupling between the capacitance portion 13 and the ground plate 40 for tuning resonance frequency and high-frequency impedance matching of the multi-band antenna 100. The base plate 11 and the capacitance portion 13 form a stair shape.

The inductance portion 14 includes an elongated first strip 141 and an L-shaped second strip 142 connected with a distal end of the first strip 141. The first strip 141 is extended opposite to the capacitance portion 13 from a top portion of the second longitudinal edge 103 of the base plate 11 and little lower than the first transverse edge 101. An upper portion of the base plate 11 defines a feeding point 111 adjacent to the joint between the first strip 141 and the second longitudinal edge 103 of the base plate 11. The second strip 142 has a short arm 1421 perpendicularly connected with a distal end of the first strip 141, and a long arm 1422 parallel with and facing to the first strip 141. The long arm 1422 is extended to face to and spaced from the base plate 11 and further beyond the base plate 11. The interspace between the base plate 11 and the long arm 1422 of the second strip 142 is smaller than the interspace between the first strip 141 and the long arm 1422 of the second strip 142. The long arm 1422 of the second strip 142 is soldered to an inner side of the ground plate 40. A slot 143 is formed between the first strip 141 and the second strip 142 to form a simulation inductance therebetween for tuning bandwidth and input impedance of the multi-band antenna 100 to realize impedance matching between the multi-band antenna 100 and a feeding cable (not shown). So that return loss is reduced, and receiving and emitting performance of the multi-band antenna 100 at the lower-frequency signal is improved.

The high frequency radiating portion 15 located at one end of the circuit board 20 has an elongated first radiating strip 151 inclinedly extended from the joint between the first strip 141 and the second longitudinal edge 103 of the base plate 11, a second radiating strip 152 extended substantially in the same direction as the first strip 141 of the inductance portion 14 from a distal end of the first radiating strip 151, a third radiating strip 153 extended perpendicularly to approach to the radiating plate 30 from a distal end of the second radiating strip 152, and a fourth radiating strip 154 extended in an opposite direction to the second radiating strip 152 and spaced from the radiating plate 30 with a distal end thereof away from the base plate 11 and hooked to solder with the radiating plate 30.

The lower frequency radiating portion 16 is of an L shape, and located at the other end of the circuit board 20 and spaced apart from the base plate 11. The lower frequency radiating portion 16 and the capacitance portion 13 are away from each other in the extending direction of the capacitance portion 13. The lower frequency radiating portion 16 has a long part 161 parallel with and spaced from the radiating plate 30, and a short part 162 perpendicularly connecting the long part 161 far away from the base plate 11 to the radiating plate 30. A distal end of the short part 162 is soldered to the inner side of the radiating plate 30. A space 163 is formed among the long part 161, the short part 162 and the radiating plate 30 to increase electric length of the radiating plate 30.

When the multi-band antenna 100 is assembled in a mobile communication equipment, the ground plate 40 is connected to the ground. Then the inductance portion 14 is connected with the ground through the ground plate 7. Because the inductance portion 14 is a narrow strip metal, the inductance portion 14 has a property of linearity. Therefore, the connection between the inductance portion 14 and the ground plate 40 can substitute for an inductor to attain the same function. The capacitance portion 13 is a strip shape spaced from the ground plate 40, so the capacitance portion 13 and the ground plate 40 produce a capacitance effect and can substitute for a capacitor to attain the same function.

When the multi-band antenna 100 is used in wireless communication, an electric current is fed into the multi-band antenna 100 via the feeding point 111. The high frequency radiating portion 15 produces a main resonance with an electromagnetic wave with a high frequency range covering 2.3 GHZ to 2.7 GHZ. Therefore, the multi-band antenna 100 can receive and transmit electromagnetic signals with bands of DCS1800 MHZ, PCS1900 MHZ, WCDMA2100 MHZ and E-UTRA2.4 GHZ in the wireless communication. The lower frequency radiating portion 16 produces a main resonance with an electromagnetic wave with a lower frequency range covering 704 MHZ to 787 MHZ. Therefore, the multi-band antenna 100 can receive and transmit electromagnetic signals with bands of GSM750 MHZ, GSM850 MHZ and GSM900 MHZ in the wireless communication.

As described above, the antenna element 10 and the radiating plate 30 are mounted on the circuit board 20 for saving occupied space so as to lower the manufacturing cost of the multi-band antenna 100. The multi-band antenna 100 receives and transmits communication bands corresponding to GSM750 MHZ, GSM850 MHZ, GSM900 MHZ, DCS1800 MHZ, PCS1900 MHZ, WCDMA2100 MHZ and E-UTRA2.4 GHZ by means of the proper arrangement of the high frequency radiating portion 15, the lower frequency radiating portion 16, the capacitance portion 13, the radiating plate 30 and the inductance portion 14 to satisfy the need of multiple and wide bands of the electromagnetic wave requested by the portable mobile communication equipments.

What is claimed is:

1. A multi-band antenna mounted on a circuit board, comprising:

an elongated ground plate perpendicularly connected to a first side edge of the circuit board; a radiating plate perpendicularly connected to a second side edge which is opposite the first side edge of the circuit board and facing the ground plate; and a planar antenna element disposed on the circuit board, comprising a high frequency radiating portion located at a first end of the circuit board with a distal end of the high frequency radiating portion connected to the radiating plate; a lower frequency radiating portion located at a second end of the circuit board opposite the first end with one end of the lower frequency radiating portion connected to the radiating plate;

a base plate located between the high and lower frequency radiating portions, the base plate connected to the radiating plate and spaced from and adjacent to the ground plate, the high frequency radiating portion extended from a first side of the base plate, the lower frequency radiating portion spaced apart from the base plate, the base plate having a feeding point arranged at a portion thereof; a capacitance portion extended from a second side of the base plate opposite the first side and parallel with and adjacent to the ground plate to form a capacitive coupling between the capacitance portion and the ground plate; and an inductance portion including an elongated first strip and an L-shaped second strip connected with a distal end of the elongated first strip, the elongated first strip extended opposite to the capacitance portion from the first side of the base plate adjacent to the ground plate, the L-shaped second strip having a short arm connected with the distal end of the elongated first strip and a long arm parallel with and adjacent to the first strip, the long arm soldered to the ground plate, a slot formed between the elongated first strip and the L-shaped second strip, a simulation inductance formed by the inductance portion.

2. The multi-band antenna as claimed in claim 1, wherein the lower frequency radiating portion is L-shaped and includes a long part parallel with and spaced from the radiating plate, and a short part extended from an end of the long part farther away from the base plate and connected to the radiating plate.

3. The multi-band antenna as claimed in claim 1, wherein the base plate is substantially rectangular-shape with a gap formed at a corner adjacent to the radiating plate and facing the lower frequency radiating portion.

4. The multi-band antenna as claimed in claim 1, wherein the high frequency radiating portion is extended from a joint between the first strip and the first side of the base plate.

5. The multi-band antenna as claimed in claim 4, wherein the high frequency radiating portion includes a first radiating strip inclinedly extended from the joint between the first strip and the first side of the base plate, a second radiating strip extended substantially in the same direction as the first strip of the inductance portion from a distal end of the first radiating strip, a third radiating strip extended perpendicularly from the second radiating strip to approach the radiating plate from a distal end of the second radiating strip, and a fourth radiating strip extended in an opposite direction to the second radiating strip and spaced from the radiating plate, with a distal end of the fourth radiating strip away from the base plate and hooked to solder with the radiating plate.

6. The multi-band antenna as claimed in claim 4, wherein the feeding point is formed adjacent to the joint between the first strip and the first side of the base plate.

7. The multi-band antenna as claimed in claim 1, wherein the long arm is extended to face and spaced from the base plate and extended further beyond the base plate.

8. The multi-band antenna as claimed in claim 7, wherein a first interspace between the base plate and the long arm of the L-shaped second strip is smaller than a second interspace between the first strip and the long arm of the L-shaped second strip.

9. The multi-band antenna as claimed in claim 1, wherein the high frequency radiating portion produces a main resonance with an electromagnetic wave with a high frequency range covering 2.3 GHZ to 2.7 GHZ, the lower frequency radiating portion produces a main resonance with an electromagnetic wave with a lower frequency range covering 704 MHZ to 787 MHZ.

* * * * *